United States Patent [19]

Roca

[11] 4,038,793

[45] Aug. 2, 1977

[54] WALL STRUCTURE

[76] Inventor: Juan Armengol Roca, c/Pompeu Fabra, 5, Bellpuig (Lerida), Spain

[21] Appl. No.: 540,947

[22] Filed: Jan. 14, 1975

[51] Int. Cl.[2] ..... E04D 15/00

[52] U.S. Cl. ..... 52/125; 52/182; 52/258; 52/432; 52/583; 52/587

[58] Field of Search ..... 52/125, 192, 249, 595, 52/182, 245, 258, 184, 248, 583, 587, 432, 438, 437; 182/90, 87

[56] References Cited

U.S. PATENT DOCUMENTS

| | | | |
|---|---|---|---|
| 838,218 | 12/1906 | Seeley | 182/87 |
| 1,436,138 | 11/1922 | Anderson | 182/90 |
| 1,445,713 | 2/1923 | Reilly | 52/125 |
| 1,523,811 | 1/1925 | Lichtenberg et al. | 52/587 |
| 1,761,848 | 6/1930 | Sitzman et al. | 52/125 |
| 1,833,875 | 11/1931 | Lockwood | 52/587 |
| 2,673,459 | 3/1954 | Overhulse | 52/192 |
| 3,331,181 | 7/1967 | Schmidt | 52/125 |
| 3,503,165 | 3/1970 | Hardt | 52/125 |

FOREIGN PATENT DOCUMENTS

| | | | |
|---|---|---|---|
| 511,728 | 5/1952 | Belgium | 52/595 |
| 755,894 | 5/1933 | France | 182/87 |
| 459,143 | 11/1949 | Italy | 182/87 |
| 1,076,748 | 7/1967 | United Kingdom | 52/595 |

*Primary Examiner*—Price C. Faw, Jr.
*Assistant Examiner*—Robert C. Farber
*Attorney, Agent, or Firm*—Michael J. Striker

[57] ABSTRACT

Wall panels are formed with horizontal edge faces. An edge portion integral with the panel projects from one of these edge faces. Another edge portion is recessed into the opposite edge face and is shaped to fit the projecting edge portion of another panel. A groove extends into each projecting and recessed edge portion to form a pair of grooves facing one another between the edge portions of successive panels. Sealing material, substantially filling the pair of grooves, completes the wall structures.

10 Claims, 8 Drawing Figures

FIG. 1
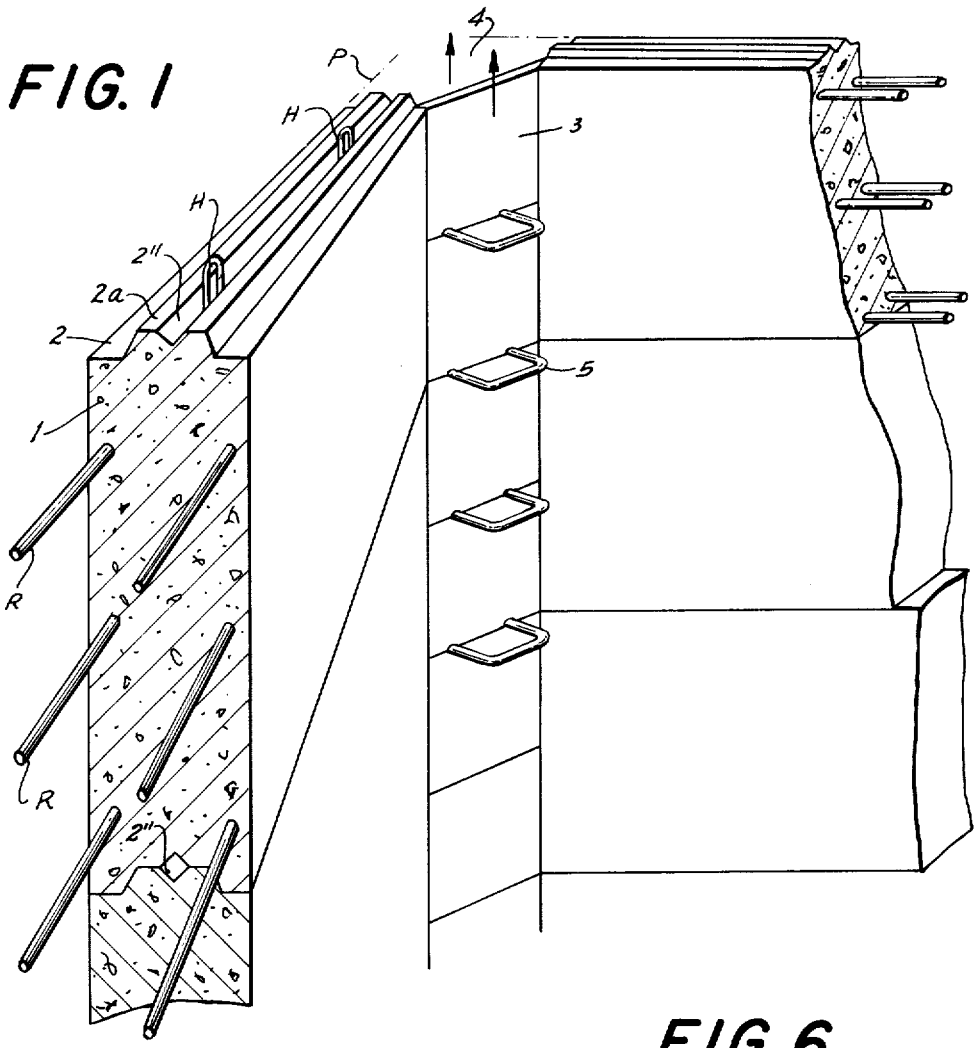
FIG. 6
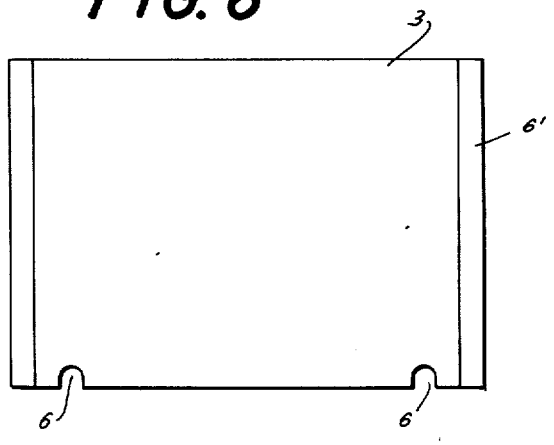
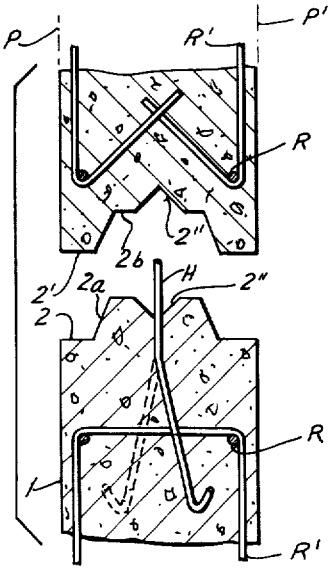
FIG. 5
FIG. 7
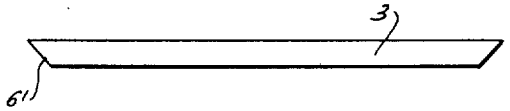

WALL STRUCTURE

BACKGROUND OF THE INVENTION

The invention relates to wall structures, used for example for the building of silos. Difficulties have been encountered in the past, with respect to the construction of water-tight and structurally sound walls, the standardization of wall elements, the cost of transporting them, the number of types of elements required for the walls, their adaptability to different silo capacities, and the cost of labor required in the various operations.

SUMMARY OF THE INVENTION

It is an object of the invention to overcome the former difficulties.

It is a further object to provide new and advantageously prefabricated parts, usually of concrete, for use in the construction of walls.

According to the invention, a wall panel for a silo or the like is provided as a standardized, prefabricated part, formed with horizontal edge faces, combined with each other by a projecting edge portion on one edge face of each panel, fitting into a recessed edge portion in an edge face of the next panel, with a pair of grooves, facing one another, in these edge portions and with sealing material in the pair of grooves.

The novel features which are considered as characteristic for the invention are set forth in particular in the appended claims. The invention itself, however, both as to its construction and its method of operation, together with additional objects and advantages thereof, will be best understood from the following description of specific embodiments when read in connection with the accompanying drawing.

BRIEF DESCRIPTION OF THE DRAWING

FIG. 1 is a fragmentary perspective view of a wall structure according to the invention;

FIG. 5 is an exploded detail from FIG. 3, shown on the scale of FIG. 1;

FIG. 6 is a side view of another detail from FIG. 1;

FIG. 7 is a top view of the detail of FIG. 6; and

DESCRIPTION OF THE PREFERRED EMBODIMENTS

As shown in FIGS. 1 to 5, square chambers of a silo are constructed with wall structures which consist of panels 1. The panels are uniformly made of cast concrete, in generally planar, elongated, prismatic form with generally rectangular cross-section, and are shown as reinforced by horizontal steel rods R and vertical rods R', between vertical planes P and P' defining the side surfaces of the panels.

According to the invention, each panel 1 has upper and lower, elongated, horizontal edge faces 2, 2' which have, respectively, an upper elongated edge portion 2*a* integral with the panel and projecting from the upper edge face 2 between the vertical planes P and P', and a lower elongated edge portion 2*b* recessed in the lower edge face 2'. These upper and lower edge faces 2 and 2' and edge portions 2*a*, 2*b* are shaped to fit one another. According to a particular feature of the invention, each upper and lower edge portion 2*a*, 2*b* has a narrow elongated groove 2'' formed therein. These grooves 2'' face one another to form a pair of grooves, and this pair of grooves is substantially filled with grout or concrete.

By this construction, the panels are most effectively joined against horizontal transverse displacement relative to each other, and also are most effectively sealed against the entrance of water. Even if water be able to enter between surfaces of edge faces of portions 2*a*, 2*b*, hardly any such water can rise to the top of the upwardly projecting portions 2*a*, and such little water as may rise to this point is safely prevented from penetrating further by the sealing material in grooves 2''.

Figure 2:
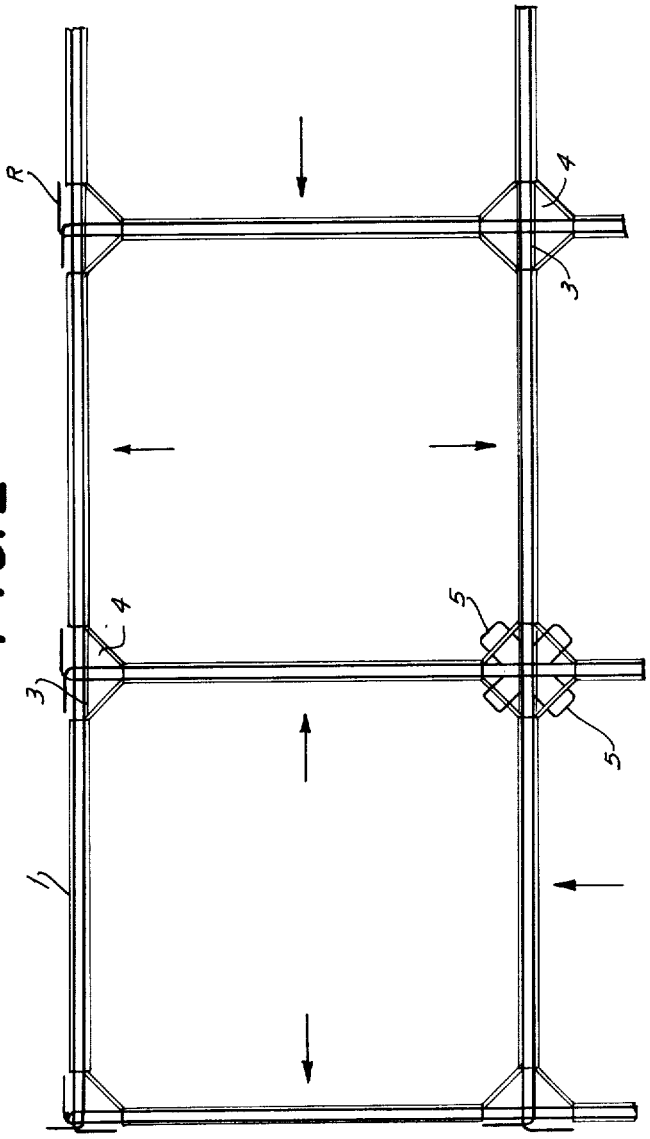
FIG. 2 is a plan view of a larger part of the structure, shown on a smaller scale.

As shown in FIGS. 2, 6 and 7, vertical pillars are constructed between vertical side edge surfaces 3*a* of panels 1. Each pillar comprises thin vertical concrete plates 3, having bevelled edges 6' to obliquely join these plates to inner ends of side edge surfaces 3a and thereby to form an inner portion of the pillar and a vertical concrete post, cast to fill a corner region 4 between the vertical outside surface of plates 3 and planes P defined by outer vertical panel surfaces. As further shown in FIGS. 1 and 2, iron steps 5 are provided, with end portions embedded in the plates 3, to make it possible to decend into the silo cells; for this purpose, passages 6 are provided in plates 3, fitting the end portions of iron steps 5.

Figure 3:
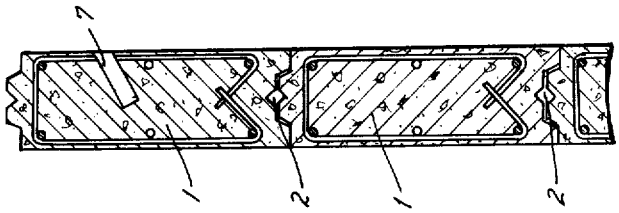
FIG. 3 is a vertical section through such a structure, shown on a scale between those of FIGS. 1 and 2.

As further shown in FIGS. 2 and 3, apertures 7 are provided in side surfaces of panels 1, at suitable points, for the mounting of scaffolds, not shown, for use in the construction of the silo.

Figure 4:
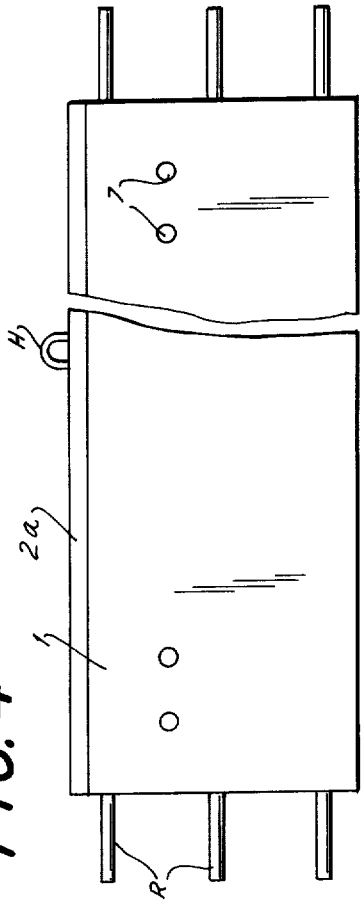
FIG. 4 is a side view of a detail from FIG. 3.

As shown in FIGS. 1, 4 and 5, steel handles H are embedded in the concrete of each panel 1, and extend a slight distance upwardly from the upper edge face 2 and through the upper groove 2'', to facilitate holding and transporting of the panels. It will be understood that the edge portions 2*a*, 2*b* and grooves 2'' are advantageously centered between the vertical side planes P and P'. The holding and carrying of a panel 1 is facilitated by this feature and by the aforementioned feature that handles H extend through the upper groove 2''.

Figure 8:
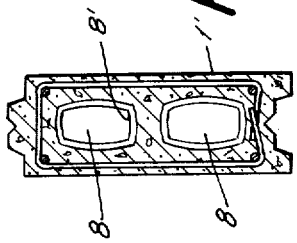
FIG. 8 is a view generally similar to part of FIG. 3 but showing a modified detail.

As shown in FIG. 8, the panels 1' can be constructed with horizontal apertures 8 extending through the same from one vertical side edge to the next. Such apertures are easy to cast in frusto-conical form, interconnected at the smaller bases 8'. The weight of the panels 1' is reduced by such construction and transportation becomes easier — a feature which is significant in various respects, and particularly where the cost of labor, used in the transportation of the panels, is a material cost element.

It will be understood that each of the elements described above, or two or more together, may also find a useful application in other types of wall structures differing from the types described above.

While the invention has been illustrated and described as embodied in a wall structure, it is not intended to be limited to the details shown, since various modifications and structural changes may be made without departing in any way from the spirit of the present invention.

Without further analysis, the foregoing will so fully reveal the gist of the present invention that others can, by applying current knowledge, readily adapt it for various applications without omitting features that, from the standpoint of prior art, fairly constitute essential characteristics of the generic or specific aspects of this invention.

What is claimed as new and desired to be protected by Letters Patent is set forth in the appended claims:

1. Wall structure comprising a plurality of generally planar wall panels, each panel having a pair of edge faces opposite and parallel to one another and a pair of vertical edges, at least one vertical edge of a respective panel being spaced from the vertical edge of a successive panel; an edge portion integral with the panel and projecting from one of said edge faces, generally in the plane of the plane of the panel; another edge portion recessed into the opposite edge face and fitting the projecting edge portion of a successive panel; a relatively narrow groove extending into each of said edge portions intermediate the lateral sides thereof, the grooves in the edge portions of successive panels facing one another, at least some of said panels having recesses in side surface portions thereof between said edge faces and adapted to permit the insertion of scaffold means during the erection of the wall structure; sealing material in the facing grooves; and vertical concrete pillar structures each located in the space bounded by the respective vertical edges of successive panels, including relatively thin concrete plates spanning said space and constituting inner surface portions of the wall structure, said plates being both thinner and narrower than said panels.

2. Wall structure as defined in claim 1, wherein said panels substantially consist of concrete.

3. Wall structure as defined in claim 2, wherein said sealing material substantially consists of concrete.

4. Wall structure as defined in claim 1, wherein said edge faces are arranged horizontally.

5. Wall structure as defined in claim 4, wherein said edge faces with said edge portions projecting therefrom are arranged as upper edge faces of each panel.

6. Wall structure as defined in claim 4, wherein said edge portions and grooves are centered between the side surfaces of each panel.

7. Wall structure as defined in claim 6, also including metallic rod means cast into each panel, said rod means extending into said facing grooves and back therefrom into the panel, to provide handle means for holding and transporting the panel during the construction of the wall structure.

8. Wall structure as defined in claim 1, wherein each of said panels has at least one elongated aperture extending through the same, parallel to said edge faces and spaced therefrom.

9. Wall structure as defined in claim 8, wherein said aperture consists of two frusto-conical recesses, each extending from a vertical edge of the panel into the panel.

10. Wall structure as defined in claim 1, particularly for a silo, wherein said plates are arranged to provide inner surface portions of the silo, at least some of said additional panels having recesses in surface portions thereof to allow insertion of steps for access to the silo.

* * * * *